US007883151B2

(12) United States Patent
Behmer et al.

(10) Patent No.: US 7,883,151 B2
(45) Date of Patent: Feb. 8, 2011

(54) FOOT SUPPORT

(76) Inventors: Debby Behmer, 233 S. Federal Hwy., Lp 21, Boca Raton, FL (US) 33432; Joyce Gale Mallia, 11200 NW. 8th St., Plantation, FL (US) 33325

( * ) Notice: Subject to any disclaimer, the term of this patent is extended or adjusted under 35 U.S.C. 154(b) by 190 days.

(21) Appl. No.: 12/285,860

(22) Filed: Oct. 15, 2008

(65) Prior Publication Data

US 2010/0090513 A1 Apr. 15, 2010

(51) Int. Cl.
*A47C 7/50* (2006.01)

(52) U.S. Cl. ..... 297/423.41; 5/651; 5/655.9

(58) Field of Classification Search ..... 297/423.41, 297/DIG. 1; 5/648, 651, 652, 655.9
See application file for complete search history.

(56) References Cited

U.S. PATENT DOCUMENTS

| | | | | | |
|---|---|---|---|---|---|
| 69,298 | A | * | 10/1867 | Adams | 297/423.41 |
| D187,122 | S | | 1/1960 | Johnson | |
| 3,345,656 | A | * | 10/1967 | Steinman | 5/650 |
| 4,364,135 | A | * | 12/1982 | Giesche | 5/650 |
| D306,084 | S | | 2/1990 | Volz et al. | |
| 4,916,765 | A | * | 4/1990 | Castronovo, Jr. | 5/640 |
| 5,158,255 | A | * | 10/1992 | Fuller | 248/118 |
| D352,401 | S | | 11/1994 | Bonazza | |
| 5,536,071 | A | * | 7/1996 | Kraftick | 297/423.41 |
| 5,845,650 | A | | 12/1998 | Limone | |
| 6,564,407 | B1 | * | 5/2003 | Luu et al. | 297/219.1 |
| D487,533 | S | | 3/2004 | Abbott et al. | |
| 6,935,697 | B2 | * | 8/2005 | Conlon et al. | 297/423.41 |
| D509,082 | S | | 9/2005 | Petruccelli | |
| 7,086,923 | B2 | | 8/2006 | Karabees | |
| 2002/0095731 | A1 | * | 7/2002 | Hall et al. | 5/646 |
| 2004/0254587 | A1 | | 12/2004 | Park | |
| 2005/0123726 | A1 | | 6/2005 | Broering et al. | |
| 2007/0094800 | A1 | * | 5/2007 | Hensley | 5/648 |
| 2007/0261165 | A1 | | 11/2007 | Tran | |

FOREIGN PATENT DOCUMENTS

| | | | |
|---|---|---|---|
| WO | WO 2006/046011 | A2 | 5/2006 |
| WO | WO 2008/008942 | A2 | 1/2008 |

* cited by examiner

*Primary Examiner*—Peter R. Brown
(74) *Attorney, Agent, or Firm*—Richard C. Litman

(57) ABSTRACT

The foot support is a support for use with pedicures or the like, and provides a comfortable rest for the user's foot or ankle. The foot support includes an elongated body having longitudinally opposed first and second ends, with the first end thereof having a recess formed therein. The recess is substantially parabolic in cross section and is adapted for receiving the heel or ankle of the user's foot. The second end of the elongated body is substantially planar and adapted for positioning on a support surface, such as the edge of a foot bath. The elongated body defines at least one outer side surface having a plurality of longitudinally extending recesses formed therein. Preferably, the elongated body is simulates a flower when viewed from an end.

12 Claims, 4 Drawing Sheets

FOOT SUPPORT

BACKGROUND OF THE INVENTION

1. Field of the Invention

The present invention relates to beauty parlor or spa accessories, and to footrests or the like, and particularly to a foot support for supporting a client's foot while administering a pedicure.

2. Description of the Related Art

Typical pedicure spas include a seat for the recipient of the pedicure, a basin or bath, often equipped with whirlpool jets for soaking and massaging the user's feet, and a footrest for supporting the user's foot. Usually the user sits on the seat while soaking his or her feet in the basin, which is usually positioned close to the floor in order to minimize the distance that a user must raise his or her feet to soak them.

During a pedicure, calluses and dry, flaky skin are abraded or scraped from the bottom of the feet. The feet are soaked in the basin of the spa in order to soften the skin on the feet. Following this softening, a technician scrubs the bottoms of the feet with a pedicure sander or a similar abrasive article. Technicians will also occasionally use a corn and callus plane to slice thick, tough callus from the feet.

Often, both the technician and the recipient of the pedicure find the pedicure process to be strenuous and tedious. The technician performing the pedicure may maintain a hunched position while exerting appreciable force in performing a repetitive sanding motion for several minutes per customer. In the course of a workday, a technician may require several breaks to recover from fatigue and back pain. Over the long term, the repetitive strain leads to a high rate of attrition as well as costly workplace related injuries. Also, the client must maintain his or her foot at a constant elevation and angle, which can cause muscle strain and discomfort for the client.

In order to facilitate the technician's access to a customer's feet during a pedicure, many conventional pedicure spas include some sort of footrest or an adjustable height basin. While such known devices improve access to the user's feet, they suffer certain shortcomings. For example, they typically include relatively complex and costly elevating mechanisms. Proper use of such a mechanism requires an understanding of the particular spa's technical specifications. As the mechanisms are not standardized, they vary widely in structure and operation from spa to spa. Additionally, such optional features increase the cost of purchasing and maintaining a spa. The elevating mechanisms are also prone to failure because they include many moving components and operate in an environment surrounded by splashing warm water, cleansers and other chemicals. Furthermore, switching from an elevated configuration to a non-elevated configuration can be tedious and time-consuming. Such footrests are, further, often uncomfortable for the user, and can be aesthetically displeasing.

Thus, a foot support solving the aforementioned problems is desired.

SUMMARY OF THE INVENTION

The foot support is a support for use with pedicures or the like, and provides a comfortable rest for the client's foot or ankle. The foot support includes an elongated body having longitudinally opposed first and second ends, with the first end thereof having a recess formed therein. The recess is substantially parabolic in cross section, and is adapted for receiving the heel or ankle of the client's foot. The second end of the elongated body is substantially planar and is adapted for positioning on a support surface, such as the edge of a foot bath.

The elongated body defines at least one outer side surface. A plurality of longitudinally extending recesses are formed in the at least one outer side surface. Preferably, the elongated body includes an outer portion and a substantially cylindrical inner core, with the outer portion defining a plurality of rounded lobes, each being positioned between adjacent pairs of the longitudinally extending recesses. This configuration allows the elongated body to be alternatively positioned on its side, with the client's heel resting in one of the longitudinally extending recesses. In cross section, the elongated body simulates a flower, with the rounded lobes simulating petals.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
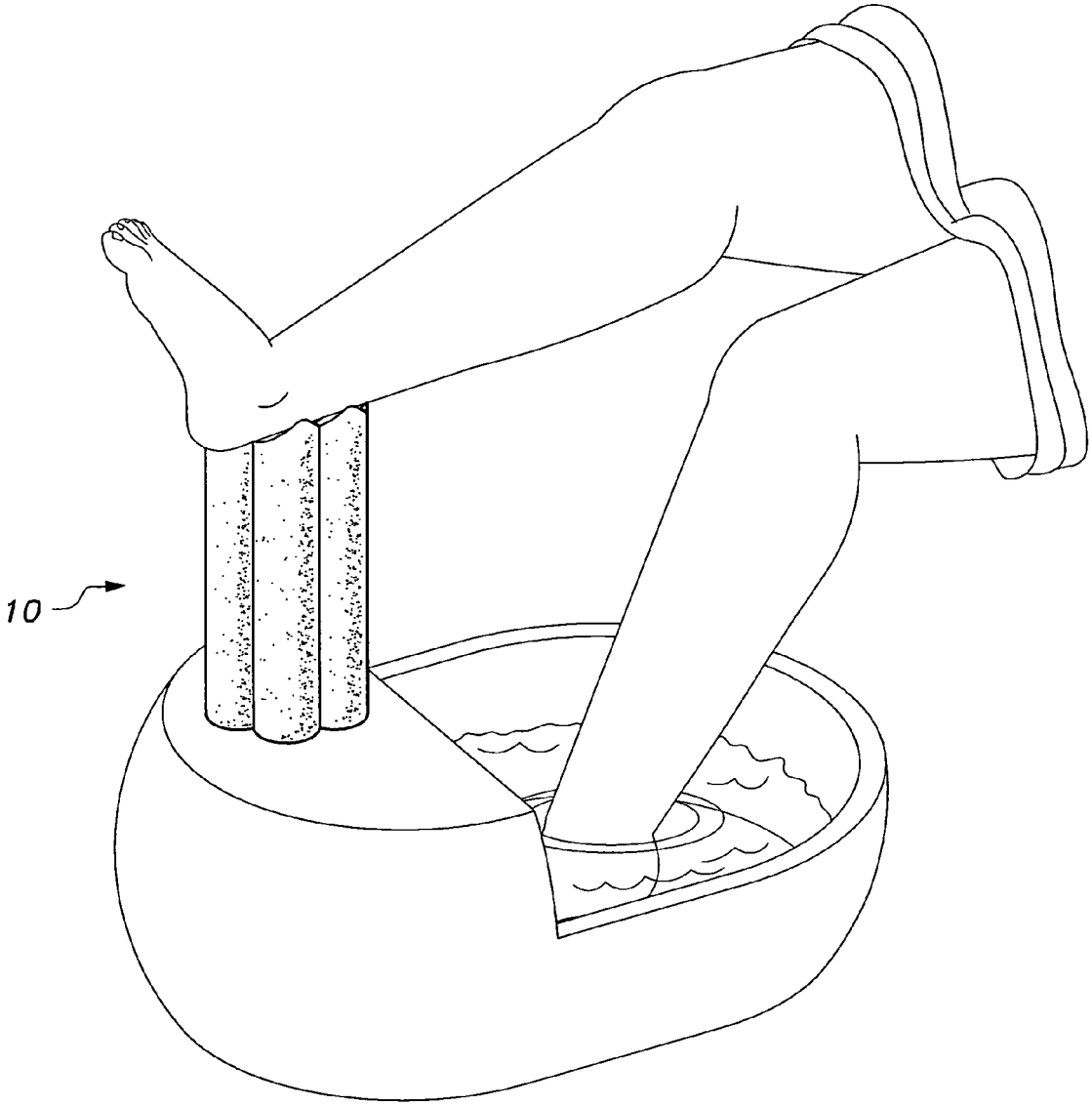
FIG. 1 is an environmental, perspective view of a foot support according to the present invention, shown with the support oriented vertically.
Figure 3:
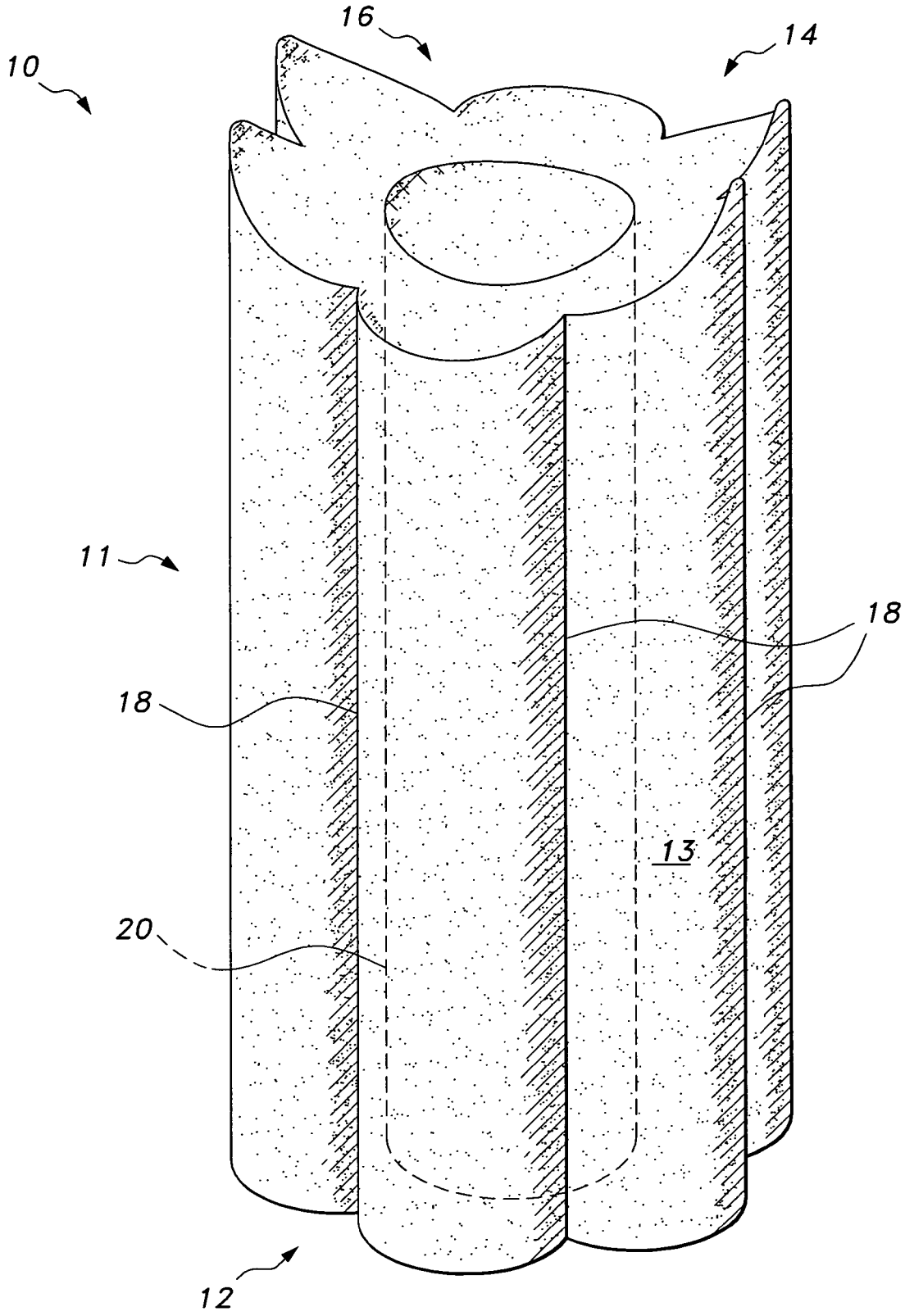
FIG. 3 is a perspective view of the foot support according to the present invention.

The foot support 10 is a support or rest for use while administering pedicures or the like, and provides a comfortable rest for the client's foot or ankle. As best shown in FIG. 3, the foot support 10 includes an elongated body 11 having longitudinally opposed first and second ends 14, 12, respectively, with the first end 14 having a recess 16 formed therein. The recess 16 is concave and substantially parabolic, being adapted for receiving the heel or ankle of the user's foot, as shown in FIG. 1. The second end 12 of the elongated body 11 is substantially planar and adapted for positioning on a support surface, such as the edge of a foot bath. Foot support 10 is easily transportable between differing work surfaces and locations.

Figure 2:
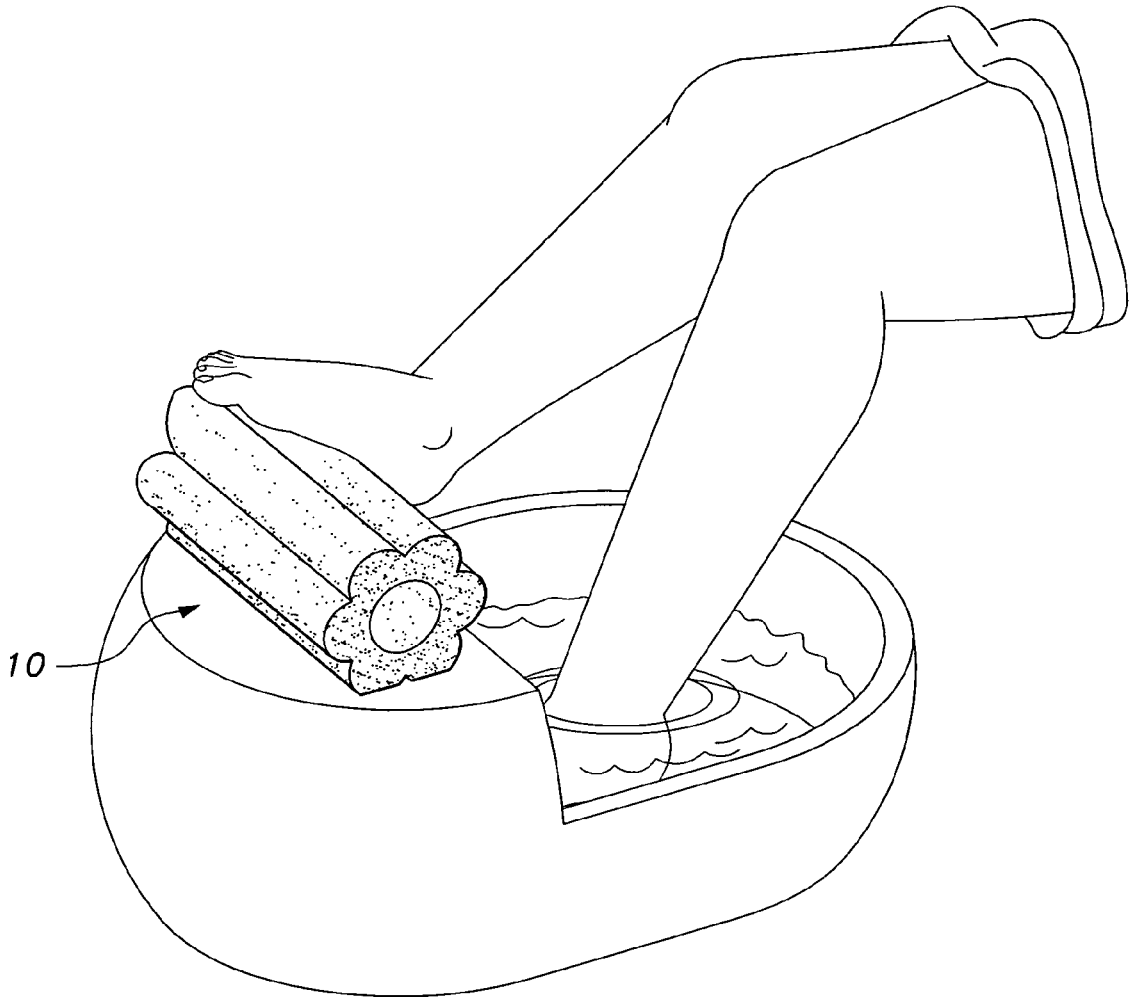
FIG. 2 is an environmental, perspective view of the foot support according to the present invention, shown with the support oriented horizontally.

The elongated body 11 defines at least one outer side surface 13, and a plurality of longitudinally extending recesses 18 are formed in the at least one outer side surface 13. Preferably, the elongated body 11 includes an outer portion 22 or layer and a substantially cylindrical inner core 20 (best shown in FIG. 4), with the outer portion 22 defining a plurality of rounded lobes 24 formed between adjacent pairs of the longitudinally extending recesses 18. This configuration allows the elongated body 11 to be alternatively positioned on its side, as shown in FIG. 2, with the user's heel resting in one of the longitudinally extending recesses 18. In this configuration, a pair of the lobes 24 act as a base, and the uppermost recess 18 receives the heel of the client's foot.

Figure 4:
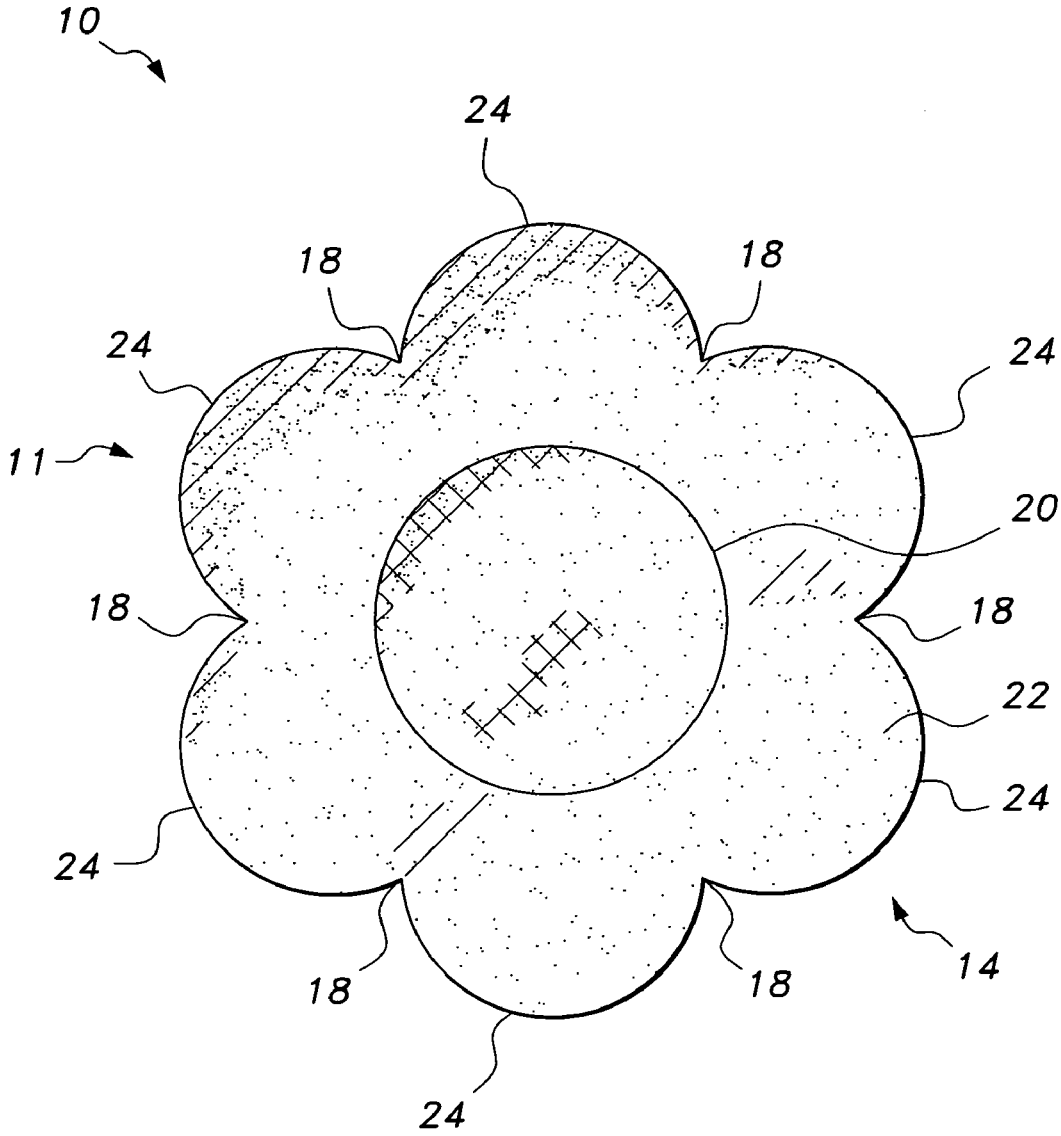
FIG. 4 is a top view of the foot support according to the present invention.

Viewed from an end, the elongated body 11 may simulate a flower, as shown in FIG. 4, with the rounded lobes 24 simulating petals and the inner core 20 simulating the center of the flower. Preferably, the elongated body 11 is formed from a waterproof, cushioned material, which is solid and structurally strong enough to support the weight of the client's foot, such as a closed-cell polyethylene foam. Further, the outer portion 22 may be formed from a differently colored foam than that of the central portion 20, thus further enhancing the floral representation. For example, the outer portion 22 may be formed from a yellow foam, and the central core 20 may be formed from a green foam.

Exemplary dimensions for foot rest 10 include a maximum height (measured along the longitudinal axis) of approximately 8½ inches, a minimum height (measured from lower end 12 to the nadir of recess 16) of approximately 7½ inches, and a maximum diameter (measured between opposed lobes 24) of approximately four inches. The central core 20 may have an exemplary diameter of approximately 1¾ inches.

It is to be understood that the present invention is not limited to the embodiment described above, but encompasses any and all embodiments within the scope of the following claims.

We claim:

1. A foot support, comprising consisting of:

an elongated body having longitudinally opposed first and second ends;

the first end having a single concave face adapted for supporting a user's foot, wherein the single concave face defines substantially the entire first end;

the second end having a substantially planar face adapted for positioning on a support surface; and the elongated body defining at least one outer side surface having a plurality of longitudinally extending recesses formed therein and defining lobes extending therealong and extending from the first end to the second end, the lobes and recesses being spaced about the periphery of the outer side surface, whereby the elongated body is inhibited from rotating when it is placed on its outer side surface and forms a support surface for a foot placed thereon.

2. The foot support as recited in claim 1, wherein said elongated body includes an outer portion and a substantially cylindrical inner core.

3. The foot support as recited in claim 1, wherein said elongated body simulates a flower when viewed from one of the ends.

4. The foot support as recited in claim 1, wherein said elongated body is made of a foam material.

5. The foot support as recited claim 4, wherein the foam material comprises polyethylene foam.

6. A foot support, comprising:

an elongated body having longitudinally opposed first and second ends;

the first end having a single concave face adapted for supporting a user's foot, wherein the single concave face defines substantially the entire first end;

the second end having a substantially planar face adapted for positioning on a support surface; and the elongated body defining at least one outer side surface having a plurality of longitudinally extending recesses formed therein and defining lobes extending therealong and extending from the first end to the second end, the lobes and recesses being spaced about the periphery of the outer side surface, whereby the elongated body is inhibited from rotating when it is placed on its outer side surface and forms a support surface for a foot placed thereon.

7. The foot support as recited in claim 6, wherein said elongated body includes an outer portion and a substantially cylindrical inner core.

8. The foot support as recited in claim 7, wherein said substantially cylindrical inner core is distinct from said outer portion.

9. The foot support as recited in claim 8, wherein the distinction between the inner core and the outer portion is color.

10. The foot support as recited in claim 6, wherein said elongated body is made of a foam material.

11. The foot support as recited claim 10, wherein said foam material comprises a waterproof, closed-cell foam.

12. The foot support as recited claim 11, wherein said foam material comprises polyethylene foam.

* * * * *